United States Patent [19]

Wood

[11] Patent Number: 4,927,396

[45] Date of Patent: May 22, 1990

[54] SONOBUOY

[75] Inventor: Gordon H. Wood, London, Canada

[73] Assignee: Her Majesty the Queen in Right of Canada as represented by the Minister of National Defence, Canada

[21] Appl. No.: 299,059

[22] Filed: Jan. 19, 1989

[30] Foreign Application Priority Data

May 26, 1988 [CA] Canada ..... 567752

[51] Int. Cl.[5] ..... F41F 5/02

[52] U.S. Cl. ..... 441/33; 367/5

[58] Field of Search ..... 441/1, 11, 21, 23, 24, 441/26–28, 32, 33; 367/3–5; 114/266, 267; 102/382, 393, 390; 89/1.51, 1.54, 1.59; 244/136, 137.4

[56] References Cited

U.S. PATENT DOCUMENTS

| | | | |
|---|---|---|---|
| 3,093,808 | 6/1963 | Tatnall | 367/4 |
| 3,530,952 | 9/1970 | Epstein | 367/4 |
| 3,541,498 | 11/1970 | Dale | 367/4 |
| 3,921,120 | 11/1975 | Widenhofer | 367/4 |
| 4,186,374 | 1/1980 | Ouellette | 367/4 |
| 4,424,733 | 1/1984 | Degen | 244/137.4 |
| 4,494,938 | 1/1986 | Flood | 441/33 |

*Primary Examiner*—Joseph F. Peters, Jr.
*Assistant Examiner*—Clifford T. Bartz
*Attorney, Agent, or Firm*—Roylance, Abrams, Berdo & Goodman

[57] ABSTRACT

A sonobuoy comprising: a container adapted to nest side-by-side and end-to-end with plural containers of the same configuration; and inflatable parafloat collapsed into an upper chamber of the container; compressed gas means in the container for inflating the parafloat; a hydrophone; a hydrophone suspending cable assembly; and release means for normally securing the hydrophone and the suspending cable assembly to the container and operable to release the hydrophone and suspending cable in response to deposition of the container in a body of water.

6 Claims, 2 Drawing Sheets

SONOBUOY

The present invention relates to sonobuoys and more particularly to small, air droppable sonobuoys.

It has been discovered that large numbers of small, passive sonobuoys are more effective for some purposes than small numbers of larger, conventional sonobuoys, e.g. "A-sized" sonobuoys. It is however, desirable to avoid significant changes in the existing aircraft carried launching systems for the sonobuoys. It is therefore of importance to be able to launch plural small sonobuoys from a standard A-size launch container.

The smaller than A-sized sonobuoy developments to date have been limited to the use of less than ten sonobuoys per launch container. For operational purposes, numbers larger than ten are considered to be more effective. Thus, the objective of the present invention is to provide a small sonobuoy that can be packed into a small space in large numbers.

According to the present invention there is provided a sonobuoy comprising:

a container adapted to nest side-by-side and end-to-end with plural containers of the same configuration;

an inflatable parafloat collapsed into an upper chamber of the container;

compressed gas means in the container for inflating the parafloat;

a hydrophone;

a hydrophone suspending cable assembly; and release means for normally securing the hydrophone and the suspending cable assembly to the container and operable to release the hydrophone and suspending cable in response to deposition of the container in a body of water.

A "parafloat" is a device for controlling air descent and acting as a float supporting the sonobuoy when in the water.

In the accompanying drawings, which illustrate an exemplary embodiment of the present invention:

Figure 1:
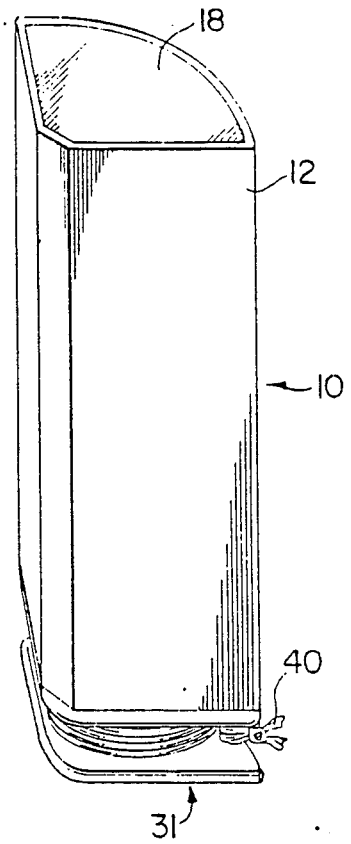
FIG. 1 is a perspective view of a sonobuoy according to the present invention.
Figure 2:
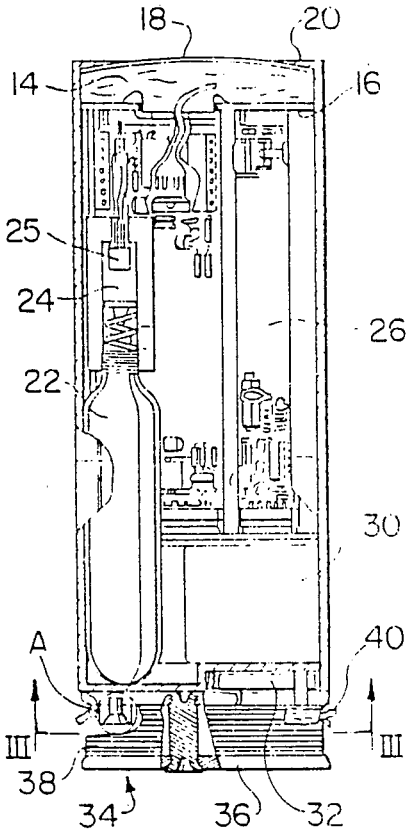
FIG. 2 is a cross sectional elevation of the sonobuoy of FIG. 1.
Figure 3:
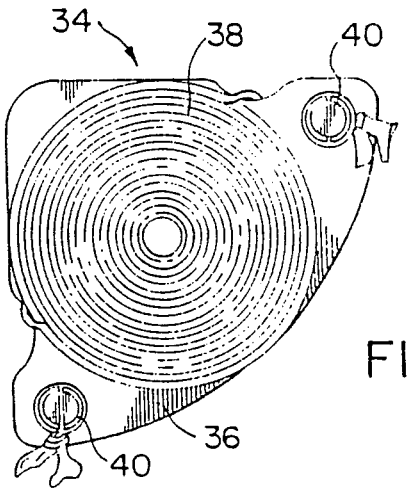
FIG. 3 is a view along lines III—III of FIG. 2.

Referring to the drawings, and particularly to FIGS. 1 through 4, there is illustrated a sonobuoy 10 mainly housed within a container 12 that is in the configuration of a 90° segment of a right circular cylinder. The top end of the container 12 houses a collapsed "parafloat" 14 that is essentially an inflatable bag. The parafloat is contained between a container partition 16, to which it is sealed and a diaphragm 18 retained in place by engagement of its edges under a lip 20 at the open top end of the container 12. The container also houses a bottle 22 of compressed $CO_2$ for inflating the parafloat. The bottle piercing mechanism 24 is actuated by an electrically fired squib 25. The pressure of the inflating parafloat is sufficient to bend the diaphragm 18 out of its retaining position under the lip 20, thus releasing the parafloat 14 for full expansion.

The container 12 also carries an electronics package 26 for signal processing and broadcasting and a battery 30.

At the bottom end of the container 12 is a hydrophone 32. It is retained in place by a suspension cable assembly 34 connected to the bottom end of the container 12. The suspension cable assembly includes a spool 36 and a hydrophone cable 38 with its respective ends connected to the hydrophone 32 and to the electronics package 26 inside the container 12.

Figure 4:
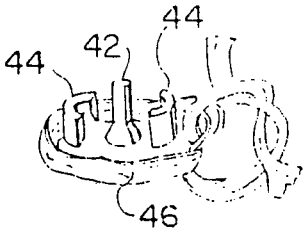
FIG. 4 is an exploded view of a release: mechanism used in the sonobuoy.
Figure 7A:
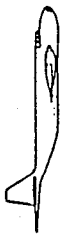
FIGS. 7*a*–7*d* are pictorial illustration of the launching sequence of the sonobuoy.
Figure 7B:
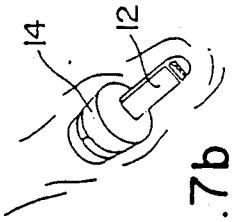
Figure 7C:
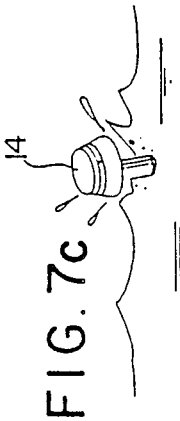
Figure 7D:
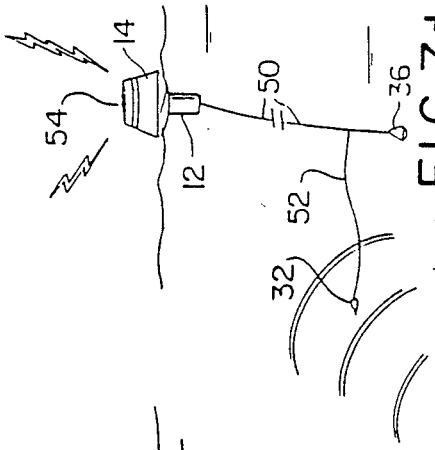

The spool 36 is held in place against the bottom of the container 12 by two release means 40 that are most clearly illustrated in FIG. 4. Each of these consists of a pin 42 projecting from the bottom of the container 12 through an appropriately sized aperture in the spool 36. A pair of retaining clips 44 engage the pin 42 between the head of the pin and the spool flange to prevent the passage of the pin back through the aperture in the spool. The clips are held in place with water soluble polyvinyl alcohol (PVA) tape 46 wrapped around the clips and tied in a knot, as illustrated in FIG. 4.

Figure 6:
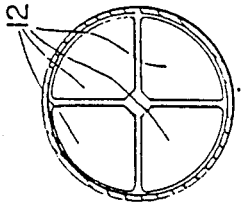
FIG. 6 is a view along line VI—VI of FIG. 5.
Figure 5:
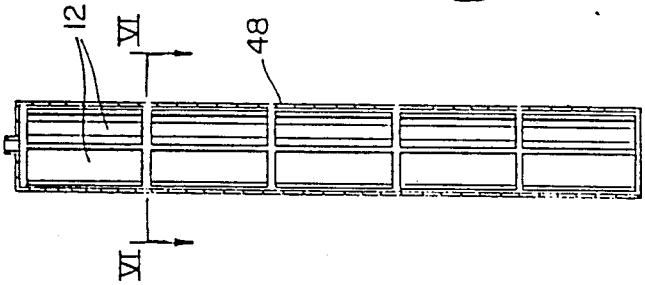
FIG. 5 is a cross sectional elevation of a sonobuoy launch container containing twenty of the sonobuoy.

As noted above, the container 12 is shaped as a 90° segment of a right circular cylinder. The spool 34 matches this configuration. The sonobuoy is thus configured such that four of the sonobuoys nested together side by side make a complete cylinder of roughly the same diameter as a conventional A size sonobuoy. The length of the sonobuoy and the cable assembly is such that the sonobuoys can be stacked five deep in a conventional A-size sonobuoy launch container 48, as illustrated in FIGS. 5 and 6.

The launching sequence of the sonobuoy is illustrated in FIG. 7. At (a), the sonobuoy is launched from an aircraft. At (b) the parafloat 14 is inflated and is subject to an aerodynamic that shows descent of the container 12. At (c) the sonobuoy is depicted as landing in a body of water. The sonobuoy will submerge and return to the surface through the buoyancy of the parafloat 14. Once in the water, the PVA tape 46 holding the retaining clips 44 in place dissolves, allowing the clips 44 to fall away from the pins 42 and consequently allowing the spool 36 to fall off the pins 42. The spool then unreels to deploy a downrigger suspension for the hydrophone 32. To effect this, the cable 38 includes a drop cable 50 that extends from the container 12 to the spool 36 and a lateral cable 52 that extends from cable 50 to hydrophone 32. The hydrophone has a neutral buoyancy, while the spool 36 acts as a ballast weight to keep the components of the sonobuoy in the state of deployment illustrated in FIG. 7(*d*). Signals picked up by the hydrophone 32 are passed through the cable 38 to the electronics package in the container 12 and broadcast through an antenna 54 within the parafloat 14.

Where it is considered desirable, the downrigger suspension can be equipped with a short length of compliance cord adjacent the container 12.

The embodiments of the invention in which an exclusive property or privilege is claimed are defined as follows:

1. A sonobuoy comprising:

a container adapted to rest side-by-side and end-to-end with plural containers of the same configuration;

an inflatable parafloat collapsed into an upper chamber of the container;

compressed gas means in the container for inflating the parafloat;

a hydrophone;

a hydrophone suspending cable assembly; and release means for normally securing the hydrophone and the suspending cable assembly to the container and operable to release the hydrophone and suspending cable in response to deposition of the container in a body of water.

2. A sonobuoy according to claim 1, wherein the container is shaped as a segment of a right circular cylinder.

3. A sonobuoy according to claim 1, including means for actuating the compressed gas means to inflate the parafloat in response to launching of the sonobuoy from a launch container.

4. A sonobuoy according to claim 1, wherein the hydrophone suspending cable assembly comprises a down-rigger suspension for the hydrophone.

5. A sonobuoy according to claim 4, wherein the hydrophone suspending cable assembly includes a cable spool secured to a hydrophone cable and releasably secured to the container by the release means.

6. A sonobuoy according to claim 5, wherein the cable spool comprises a ballast weight.

* * * * *